United States Patent [19]

Glikin

[11] 4,253,802

[45] Mar. 3, 1981

[54] LIQUID FUEL INJECTION PUMPING APPARATUS

[75] Inventor: Paul E. Glikin, Maidstone, England

[73] Assignee: Lucas Industries Limited, Birmingham, England

[21] Appl. No.: 59,210

[22] Filed: Jul. 20, 1979

[30] Foreign Application Priority Data

Aug. 1, 1978 [GB] United Kingdom ..... 31839/78

[51] Int. Cl.[3] ..... F04B 23/08

[52] U.S. Cl. ..... 417/199 A; 123/446; 417/249; 417/251

[58] Field of Search ..... 417/199 A, 199 R, 200, 417/244, 249, 251, 295, 297.5, 298, 306, 435, 242; 123/139 AN, 139 AV

[56] References Cited

U.S. PATENT DOCUMENTS 3,904,319 9/1975 Paish et al. ..... 417/199 A X 4,066,386 1/1978 Johnson et al. ..... 417/199 A

FOREIGN PATENT DOCUMENTS 1486277 9/1977 United Kingdom ..... 417/199 A

*Primary Examiner*—Carlton R. Croyle
*Assistant Examiner*—Edward Look

[57] ABSTRACT

A fuel pumping apparatus comprises feed pump supplying fuel to an injection pump. A chamber is located between the two pumps and has an outlet including a restricted orifice extending from the upper end of the chamber through which fuel and air collecting in the chamber can flow. A float is located in the chamber and mounts a valve member which can cooperate with a seating defined about a lower outlet in the lower wall of the chamber. The lower outlet connects with the injection pump and is obstructed if the chamber becomes filled with air to prevent the supply of air to the injection pump.

4 Claims, 1 Drawing Figure

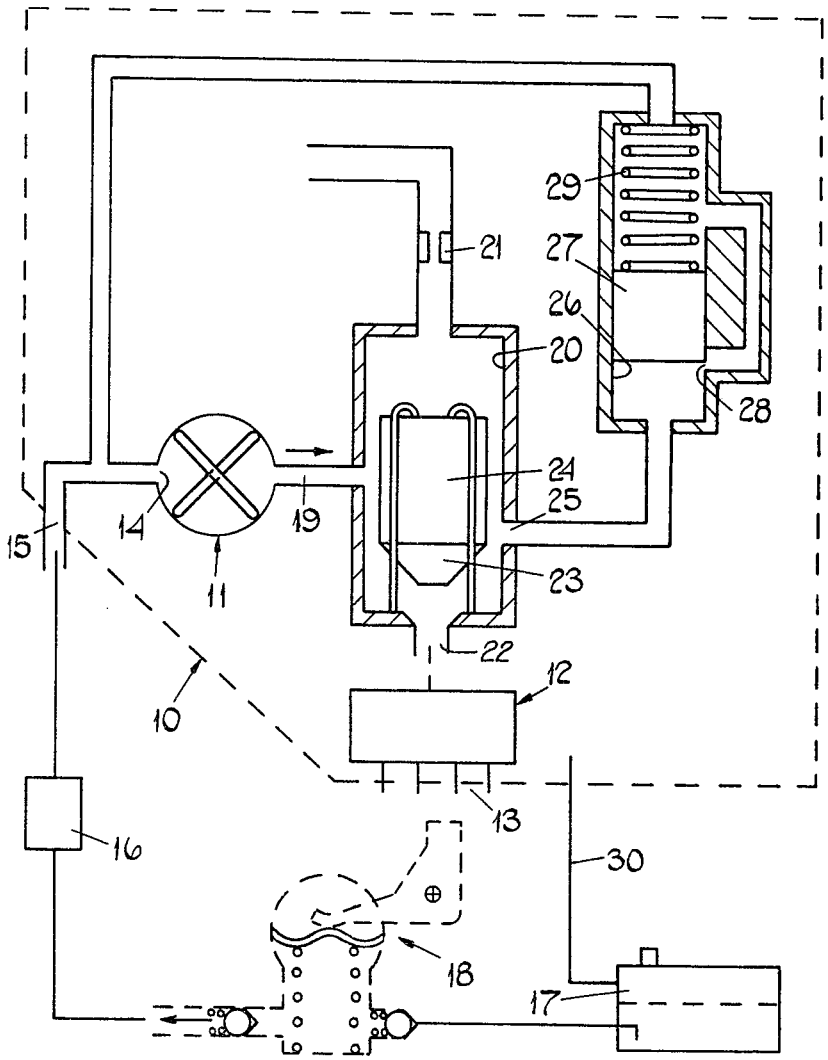
29
21
27
26
20
28
24
25
14
19
15
11
23
22
12
10
13
16
30
18
17

LIQUID FUEL INJECTION PUMPING APPARATUS

This invention relates to a liquid fuel injection pumping apparatus for supplying fuel to an internal combustion engine and of the kind comprising a housing, an injection pump located within the housing and operable in timed relationship with the associated engine to supply fuel to the combustion spaces of the engine in turn, a feed pummp in the housing for supplying fuel to the injection pump, the feed pump having an inlet port connected to a fuel inlet on the housing and an outlet through which fuel flows to the injection pump, said fuel inlet in use being connected to a fuel supply tank, a space defined within the housing and into which fuel leaking from the injection pump can flow and an outlet communicating with said space and which in use is connected to a pipe communicating with the fuel supply tank.

Such apparatus is well known in the art. It is also well known in the art that certain types of fuel injection pump are difficult to purge of air once air has collected within the various passages of the pump. It is therefore desirable to ensure that so far as is possible, no air flows through the injection pump whilst the apparatus is in use. Various arrangements are known for trapping the air for example in a filter unit disposed between the apparatus and the fuel tank. The air may be discharged from the filter unit using the pressure developed by a lift pump disposed between the filter unit and the tank. In some cases however, a lift pump is not provided and the feed pump only is used to draw the fuel from the tank. In this case some means is required to prevent the air reaching the injection pump and it is known to provide a restricted orifice through which the air along with some fuel is bled from the outlet of the feed pump and returned to the tank. This restricted orifice is often provided even when the lift pump is utilised and it has provded to be adequate for dealing with small quantities of air in the fuel. In the event a large quantity of air enters the feed pump the orifice may not be able to cope and so air will find its way into the injection pump which may as a result cease to supply fuel. Such a quantity of air may enter the feed pump due to the fact that the level of fuel in the fuel tank has fallen to a point such that air is drawn into the feed pump by way of the fuel inlet.

The object of the invention is to provide an apparatus of the kind specified in a simple and convenient form.

According to the invention an apparatus of the kind specified comprises a chamber, a float within said chamber and a float controlled valve, said float controlled valve controlling the flow of fuel from said chamber to the injection pump, an inlet to said chamber from the feed pump and an outlet from the upper part of said chamber said outlet including a restricted orifice, the arrangement being such that air flowing into said chamber can be discharged from the chamber by way of said restricted orifice but in the event that air tends to collect in the chamber, the float will be depressed to close said valve thereby to prevent the flow of air to the injection pump.

One example of a fuel injection pumping apparatus in accordance with the invention will now be described with reference to the accompanying drawings. The apparatus is generally indicated at 10 the housing of the apparatus being shown in dotted outline. Within the housing there is located a vane type fuel feed pump 11 which supplies fuel to an injection pump 12 also located within the housing. The injection pump 12 has a plurality of outlets 13 extending to the exterior of the housing, the outlets 13 in use being connected to the fuel injection nozzles of the associated engine respectively. Means (not shown) is incorporated in the injection pump for controlling the rate of fuel supply to the engine.

The feed pump 11 has an inlet port 14 which communicates with a fuel inlet 15 on the housing and which is connected by way of a filter unit 16 to a fuel tank 17. As shown in the drawing an engine cam actuated lift pump 18 is provided between the fuel tank and the filter unit but this is not necessarily provided.

The outlet 19 of the feed pump is connected to a chamber 20 which is defined within the housing, the port through which the outlet opens into the chamber 20 being substantially mid-way between the upper and lower ends of the chamber. The upper end of the chamber is vented through an orifice 21 to the space defined within the housing and which also receives leakage fuel from the injection pump 12.

Formed in the wall at the lower end of the chamber is an outlet 22 which communicates with the fuel inlet of the injection pump. The outlet 22 defines a seating for engagement by a valve member 23 which is carried by a float 24. The float 24 is constrained within a cage but is constructed from material which is buoyant in the fuel and unaffected thereby.

Also formed in the wall of the chamber at a position intermediate the port through which fuel enters the chamber and the outlet 22 is a further outlet 25 which communicates with one end of a cylinder 26 containing an axially movable valve member in the form of a piston 27. Formed in the wall of the cylinder is a spill port 28 which communicates with the other end of the cylinder 26 and with the point intermediate the fuel inlet 15 and the port 14. This end of the cylinder contains a spring 29 biassing the piston 27 towards a position to close the port 28.

In operation, fuel is supplied through the outlet port 19 to the interior of the chamber 20 and a small quantity of fuel flows to the space defined within the housing through the restricted orifice 21. This fuel returns to the fuel tank by way of a conduit 30. The outlet pressure of the feed pump is controlled by spilling fuel through the port 28, the outlet pressure for this purpose acting on the piston 27 in opposition to the force exerted by the spring 29. As the pressure tends to increase the piston will be moved further against the action of the spring to spill more fuel through the port 28 and thereby the outlet pressure of the feed pump is controlled. Fuel is supplied to the injection pump from the lower end of the chamber 20 the valve member 23 being held clear of the seating defined about the outlet. In the event that a small quantity of air is drawn through the fuel inlet 15 then the air will tend to flow through the orifice 21 into the aforesaid space. However, in the event that a large quantity of air enters through the fuel inlet because for example the fuel level in the tank 17 has fallen sufficiently to expose the suction pipe, the vane pump will deliver air to the chamber 20 in a quantity in excess of that which can flow through the restricted orifice 21. In this case therefore, the level of fuel in the chamber 20 will fall and at a predetermined level the float will start to move downwardly until a point is reached at which the valve member 23 obturates the port 22 and when this occurs no further fuel will be supplied to the injection pump and what is more important, air will be prevented from flowing to the injection pump. As a result the associated engine will be starved of fuel and will cease to operate.

If a fresh supply of fuel is placed in the tank and the engine cranked then the vane pump will deliver air into the chamber 20 and this air will flow through the orifice 21. When fuel starts to flow through the vane pump the chamber will gradually fill with fuel and the float will move from the seating defined about the outlet 22 thereby allowing a fuel to flow to the injection pump which in turn will start to supply fuel to the associated engine.

It has been mentioned that the lift pump 18 is an optional feature. If the lift pump is provided then purging of the air can be achieved more quickly if a vent is opened on the filter unit 16.

I claim:

1. A liquid fuel injection pumping apparatus for supplying fuel to an internal combustion engine and of the kind comprising a housing, an injection pump located within the housing and operable in timed relationship with the associated engine to supply fuel to the combustion spaces of the engine in turn, a feed pump in the housing for supplying fuel to the injection pump, the feed pump having an inlet port connected to a fuel inlet on the housing and an outlet through which fuel flows to the injection pump, said fuel inlet in use being connected to a fuel supply tank, a space defined within the housing and into which fuel leaking from the injection pump can flow, an outlet on said housing communicating with the fuel supply tank, means forming a chamber, a float within said chamber, and a float controlled valve, said float controlled valve controlling the flow of fuel from said chamber to the injection pump, an inlet to said chamber from the feed pump and an outlet from the upper part of said chamber said outlet including a restricted orifice, the arrangement being such that air flowing into said chamber can be discharged from the chamber by way of said restricted orifice but in the event that air tends to collect in the chamber, the float will be depressed to close said valve thereby to prevent the flow of air to the injection pump.

2. An apparatus according to claim 1 including a further outlet from said chamber, said further outlet communicating with said injection pump, said further outlet extending from the lower end of said chamber and the float mounting the valve member at its lower end for co-operation with a seating defined abut said further outlet.

3. An apparatus according to claim 2 in which said inlet opens into said chamber at a position intermediate the upper and lower ends of the chamber.

4. An apparatus according to claim 3 including a cage to limit the movement of the float valve away from said seating.

* * * * *